US009128435B2

(12) United States Patent
Fukasaka et al.

(10) Patent No.: US 9,128,435 B2
(45) Date of Patent: Sep. 8, 2015

(54) FIXING DEVICE AND IMAGE FORMING APPARATUS INCLUDING THE SAME

(71) Applicant: CANON KABUSHIKI KAISHA, Tokyo (JP)

(72) Inventors: Toshihiro Fukasaka, Kawasaki (JP); Hisae Shimizu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/146,031

(22) Filed: Jan. 2, 2014

(65) Prior Publication Data

US 2014/0193170 A1 Jul. 10, 2014

(30) Foreign Application Priority Data

Jan. 8, 2013 (JP) ..... 2013-001289

(51) Int. Cl.
*G03G 15/20* (2006.01)

(52) U.S. Cl.
CPC ..... *G03G 15/2057* (2013.01)

(58) Field of Classification Search
CPC ..... G03G 15/2057
USPC ..... 399/90
See application file for complete search history.

(56) References Cited

U.S. PATENT DOCUMENTS

| | | | | |
|---|---|---|---|---|
| 5,616,263 | A * | 4/1997 | Hyllberg | 219/469 |
| 5,822,670 | A * | 10/1998 | Morigami | 399/334 |
| 8,331,824 | B2 * | 12/2012 | Choi et al. | 399/92 |
| 8,346,148 | B2 * | 1/2013 | Yonekawa et al. | 399/329 |
| 2014/0153980 | A1 * | 6/2014 | Kiyama et al. | 399/329 |

FOREIGN PATENT DOCUMENTS

| | | |
|---|---|---|
| JP | 05-035137 A | 2/1993 |
| JP | 2002-123113 A | 4/2002 |

OTHER PUBLICATIONS

U.S. Appl. No. 14/272,706 to Hisae Shimizu et al., filed May 8, 2014.

* cited by examiner

*Primary Examiner* — Clayton E Laballe
*Assistant Examiner* — Leon W Rhodes, Jr.
(74) *Attorney, Agent, or Firm* — Fitzpatrick, Cella, Harper & Scinto

(57) ABSTRACT

A fixing film is formed by stacking a heating layer, an electrical conducting layer, and an insulation layer interposed between the heating layer and the electrical conducting layer. A current supplied from a secondary coil flows through stacked layers formed by the secondary coil, the heating layer, an electrical conducting member, and the electrical conducting layer. The electrical conducting member and electrical conducting layer function as a current return path.

8 Claims, 8 Drawing Sheets

FIXING DEVICE AND IMAGE FORMING APPARATUS INCLUDING THE SAME

BACKGROUND OF THE INVENTION

1. Field of the Invention

The present invention relates to a fixing device which fixes an unfixed image onto a sheet, and an image forming apparatus including it.

2. Description of the Related Art

In an image forming apparatus such as a copying machine or laser printer, a film heating scheme is known as a scheme of fixing an unfixed toner image onto a sheet. Japanese Patent Laid-Open No. 5-35137 proposes a method of arranging a plurality of heating resistors in a zigzag pattern on a fixing film, and heating the fixing film. Japanese Patent Laid-Open No. 2002-123113 proposes a fixing device which supplies electric power to a heating element in a non-contact manner. In the fixing device of Japanese Patent Laid-Open No. 2002-123113, electric power is supplied from a power source connected to a primary coil to a heating element coupled to a secondary coil by magnetic coupling between the primary and secondary coils each including a core and coil.

Two electrodes are necessary to supply a current to the heating element. In a fixing device of Japanese Patent Laid-Open No. 5-35137, a return path for connecting an electrode farther from a power supply part out of the electrodes at the two ends of the zigzag pattern is arranged in the same layer as that of the zigzag pattern in order to supply a current from one end side of the fixing film.

However, in Japanese Patent Laid-Open No. 5-35137, since the heating resistors are formed from the zigzag pattern, pressure unevenness is generated in the fixing film. The return path is linear and extends in a direction perpendicular to the rotational direction of the fixing film, and this also causes pressure unevenness of the fixing film. Further, the pressure unevenness sometimes produces density unevenness or a pattern in a printed image. In Japanese Patent Laid-Open No. 2002-123113, a surface exfoliate layer and elastic layer are formed on the outer surface of the cored bar of a fixing roller, and a heating layer and insulation layer are formed integrally with the inner surface of the cored bar. The presence of the cored bar in the fixing roller makes it difficult to generate pressure unevenness. However, Japanese Patent Laid-Open No. 2002-123113 does not clearly describe how to supply a current to an electrode farther from the power supply part out of the two electrodes of the heating element, in order to supply electric power to the heating element by arranging the primary and secondary coils on one end side of the fixing roller. It is technically difficult to wire a cable from one end side to the other end side of the fixing roller, as illustrated in some drawings. This is because the cable is tangled around a stay which pushes a heating film against a pressing roller from the inner side of the heating film.

SUMMARY OF THE INVENTION

The present invention provides a fixing device capable of easily supplying electric power to two electrodes of a heating element from one end portion while preventing generation of fixing unevenness.

A fixing device may comprise the following elements. A hollow fixing body rotates and generates heat to heat an unfixed image carried by a sheet. A pressing body rotates in press contact with the fixing body and adds a pressure to the sheet and the unfixed image. A pushing member pushes the fixing body against the pressing body from an inner side of the fixing body and slides on the inner side of the fixing body. A power supply unit supplies electric power for causing the fixing body to generate heat. The fixing body is formed by stacked layers including stacking a heating layer, an electrical conducting layer, and an insulation layer interposed between the heating layer and the electrical conducting layer. Two electrodes of the power supply unit are connected to the heating layer and the electrical conducting layer at one end portion of the fixing body in a rotation axis direction. The heating layer and the electrical conducting layer are connected by an electrical conducting member arranged in the fixing body at the other end portion of the fixing body in the rotation axis direction. A current supplied from the power supply unit flows through one of the two electrodes, the heating layer, the electrical conducting member, the electrical conducting layer and the other of the two electrodes.

Further features of the present invention will become apparent from the following description of exemplary embodiments (with reference to the attached drawings).

DESCRIPTION OF THE EMBODIMENTS

Figure 1:
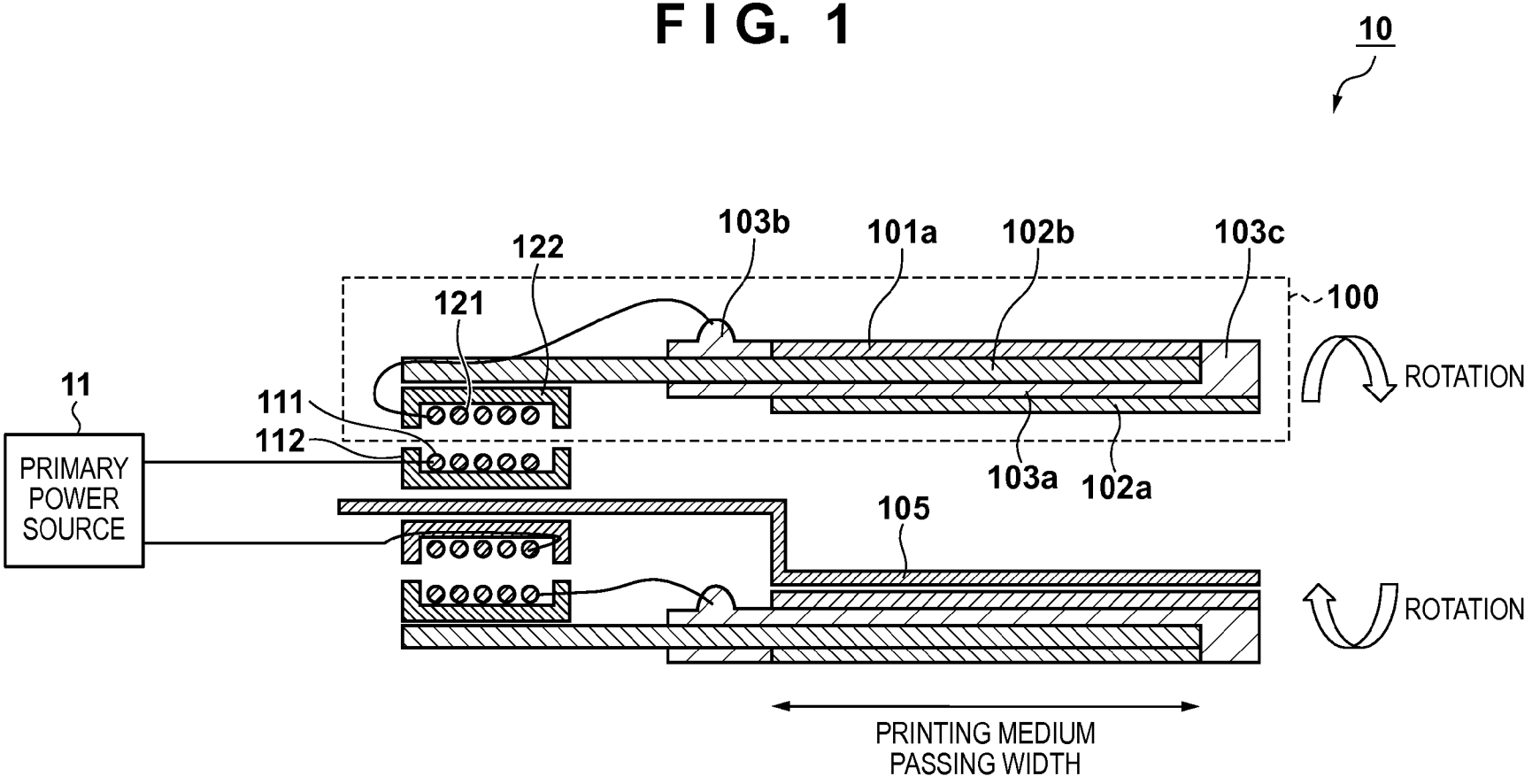
FIG. 1 is a view showing the arrangement of a fixing device.

A fixing device according to the first embodiment of the present invention will be described with reference to FIG. 1. FIG. 1 is a sectional view showing a fixing device 10 taken along the rotation axis. Electric power is supplied from a primary power source 11 to a fixing film 100 by non-contact electric power transmission. This scheme has an advantage of generating no wear of an electrode by friction, in comparison with a contact electric power transmission scheme of supplying electric power using a brush or the like.

As shown in FIG. 1, the fixing film 100 is a rotating film-like hollow (that is, endless) fixing body and is formed from a plurality of layers. A first insulating layer 102*a* is arranged as an innermost layer. A first electrical conducting layer 103*a* is stacked on the first insulating layer 102*a*. A second insulating layer 102*b* is stacked on (the outer side of) the first electrical conducting layer 103*a*. A heating layer 101*a* is stacked on (the outer side of) the second insulating layer 102*b*. Each layer basically has a cylindrical shape of a uniform layer thickness. This multilayered structure is employed at a portion of the fixing film 100 where a sheet passes in the rotation axis direction, and the multilayered structure is slightly different at a portion where no sheet passes.

Ring-shaped second and third electrical conducting layers 103*b* and 103*c* are formed at the two ends of the heating layer 101*a* in the rotation axis direction of the fixing film 100. The second electrical conducting layer 103*b* is arranged at one end portion (left side in FIG. 1) in the rotation axis direction of the fixing film 100. The third electrical conducting layer 103*c* is arranged at the other end portion (right side in FIG. 1). In this manner, the third electrical conducting layer 103*c* is arranged at an end portion farther from the primary power source 11 in the axial direction of the fixing film 100 out of the two end portions of the fixing film 100, and functions as a current return path. That is, the third electrical conducting layer 103*c* functions as an electrical conducting member which electrically connects the heating layer 101*a* and first electrical conducting layer 103*a*. Note that the third electrical conducting layer 103*c* may also generate heat and function as a heating layer. By forming the second and third electrical conducting layers 103*b* and 103*c* from ring-shaped (cylindrically-shaped) electrical conducting member, a current can be easily supplied to the entire heating layer 101*a*, and temperature unevenness hardly occurs.

The heating layer 101*a* in the axial direction of the fixing film 100 has a width enough to heat a sheet satisfactorily and fix an unfixed toner image. The width of the heating layer 101*a* is set to be a value equal to or larger than the maximum width of a sheet assumed in design.

A secondary core 122 is fixed to an end portion near the primary power source 11 in the axial direction of the fixing film 100 out of the two end portions of the fixing film 100. The secondary core 122 is attached to the inner circumferential surface of the fixing film 100 and rotates together with the fixing film 100. A secondary coil 121 is wound around the secondary core 122. The secondary coil 121 functions as an electric power supply unit which supplies, to the fixing film 100, electric power for heating the fixing film 100.

One end of the secondary coil 121 is connected to the second electrical conducting layer 103*b* formed parallelly with the heating layer 101*a*. The other end of the secondary coil 121 is connected to the first electrical conducting layer 103*a*. In this fashion, the secondary coil 121, second electrical conducting layer 103*b*, heating layer 101*a*, third electrical conducting layer 103*c*, and first electrical conducting layer 103*a* form a circuit (loop/current path). Especially, the third electrical conducting layer 103*c* functions as a return path for transferring a current from the heating layer 101*a* to the first electrical conducting layer 103*a* or from the first electrical conducting layer 103*a* to the heating layer 101*a*.

Figure 2:
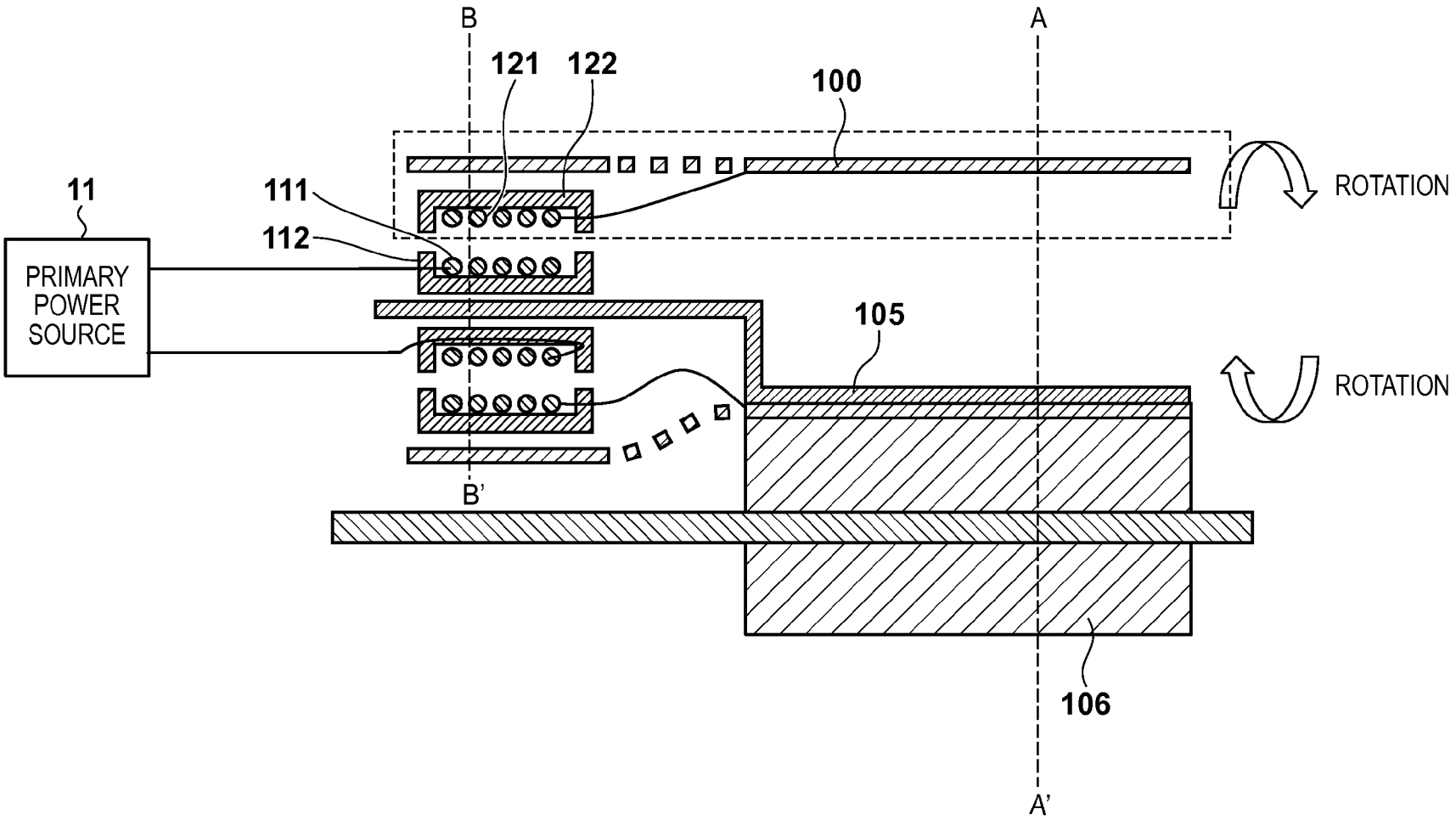
FIG. 2 is a view showing the arrangement of the fixing device.

As shown in FIG. 2, the fixing film 100 rotates as a driven roller along with a pressing roller 106. The fixing film 100, secondary core 122, and secondary coil 121 are integrated, and thus rotate integrally when the fixing device 10 operates. The pressing roller 106 is a pressing body which rotates in press contact with the fixing film 100. The pressing roller 106 fixes an unfixed image onto a sheet by heating the sheet carrying the unfixed image and adding a pressure to it while the fixing film 100 and pressing roller 106 nip and convey the sheet. Note that the fixing film 100 may be driven by a dedicated driving source such as a motor (not shown).

As shown in FIGS. 1 and 2, a primary core 112 and a primary coil 111 are further arranged on the inner side of the secondary core 122 and the secondary coil 121. That is, the secondary core 122, the secondary coil 121, the primary core 112, and the primary coil 111 are arranged in a concentric fashion using the rotation axis of the fixing film 100 as the center. Since the primary coil 111 and the secondary coil 121 are electromagnetically coupled, electric power supplied from the primary power source 11 is transmitted to the secondary coil 121 via the primary coil 111. This implements non-contact electric power transmission.

A current generated in the secondary coil 121 by electromagnetic induction flows from one end of the secondary coil 121 into the second electrical conducting layer 103*b* of the fixing film 100 via a power supply wire. The power supply wire may be part of the secondary coil 121, such as a Litz wire. The current further flows into the heating layer 101*a* via the second electrical conducting layer 103*b*. The current having passed through the heating layer 101*a* is returned by the third electrical conducting layer 103*c* and flows into the first electrical conducting layer 103*a*. Further, the current flows into the other end of the secondary coil 121. Accordingly, the current flows through the loop formed by the secondary coil 121, second electrical conducting layer 103*b*, the heating layer 101*a*, the third electrical conducting layer 103*c*, and the first electrical conducting layer 103*a*. Note that the direction in which a current flows may be in the opposite direction.

Although FIGS. 1 and 2 do not illustrate an elastic layer and exfoliate layer, an elastic layer and exfoliate layer may be further arranged on the outer side of the heating layer 101*a*. The multilayered cylindrically-shaped fixing film 100 is manufactured by a method of stacking layers while applying a material of each layer, a method using evaporation, sputtering, or the like, or a method of combining them.

As shown in FIG. 2, the pressing roller 106 presses the fixing film 100 to make part of the fixing film 100 flat. The flat portion functions as a so-called nip portion. When a sheet passes through the nip portion, the sheet and an unfixed image are heated and pressurized.

The fixing film 100 is a very thin flexible body. A pressing/holding member 105 is therefore arranged on the inner surface side of the fixing film 100 so that a sufficient pressure can be added to a sheet. The pressing/holding member 105 slides on the inner circumferential surface of the fixing film 100 and pushes the fixing film 100 toward the pressing roller 106. In this way, the pressing/holding member 105 functions as a pushing member which pushes the fixing film 100 against the pressing roller 106 from the inner side of the fixing film 100 and slides on the inner side of the fixing film 100.

Figure 3:
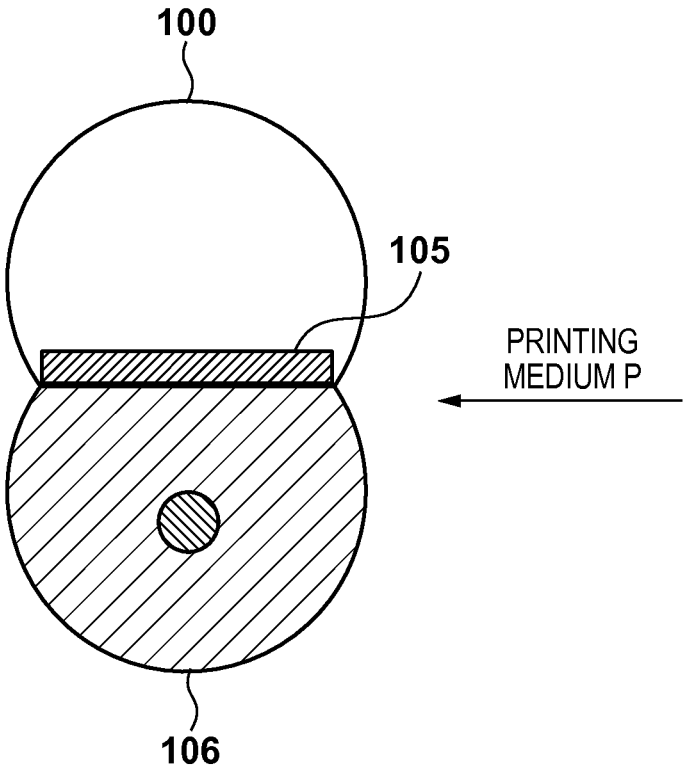
FIG. 3 is a sectional view taken along a line A-A' in FIG. 2.

FIG. 3 shows a section taken along a line A-A' shown in FIG. 2. Since the fixing film 100 is pushed by the pressing/holding member 105, a nip portion can be formed between the fixing film 100 and the pressing roller 106. An image formed on a sheet P is pressurized, heated, and fixed when passing through the nip portion. The sheet may also be called a printing medium, paper, printing material, transfer material, or transfer paper.

Figure 4:
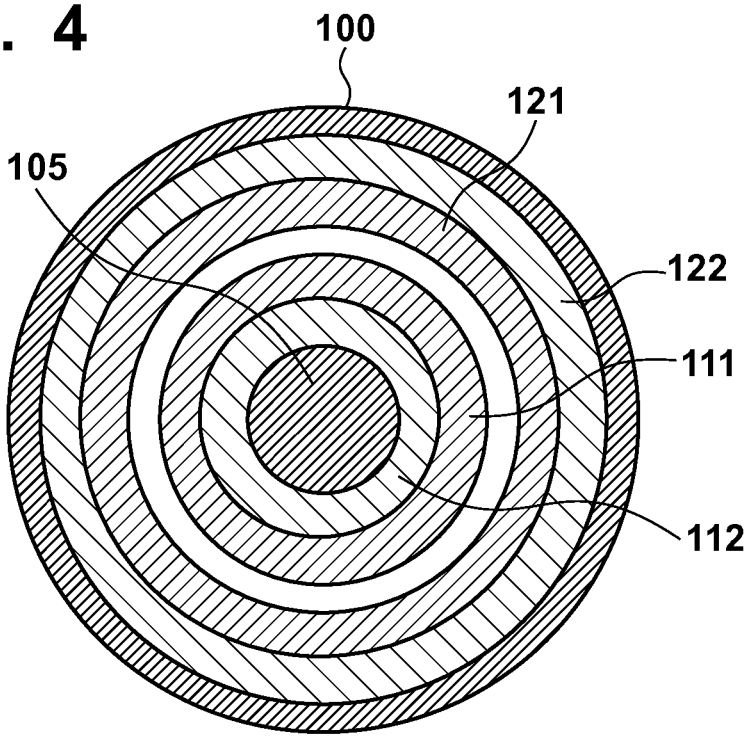
FIG. 4 is a sectional view taken along a line B-B' in FIG. 2.

FIG. 4 is a sectional view taken along a line B-B' shown in FIG. 2. The fixing film 100 is arranged as an outermost layer, and the secondary core 122 is arranged on the inner side of it. The secondary coil 121 is wound on the inner side of the secondary core 122. The primary coil 111 and the primary core 112 are arranged on the inner circumferential side of the secondary coil 121. The secondary core 122 and the primary core 112 are separate bodies and do not contact each other. However, electromagnetic coupling between the primary coil 111 and the secondary coil 121 induces electric power in the secondary coil 121.

The pressing/holding member 105 is arranged on the inner side of the primary core 112. The two or one end of the pressing/holding member 105 is fixed to the housing of an image forming apparatus or the like. The primary core 112 and pressing/holding member 105 may be fixed in contact with each other. Alternatively, the end portion of the pressing/holding member 105 may be inserted into a through hole formed at the center of the primary core 112 without bringing the primary core 112 and pressing/holding member 105 into contact with each other. In the first embodiment, the pressing/holding member 105 is arranged on the inner side of the fixing film 100 in order to form a nip portion between the multilayered fixing film 100 formed from a flexible body, and the pressing roller 106.

Figure 5:
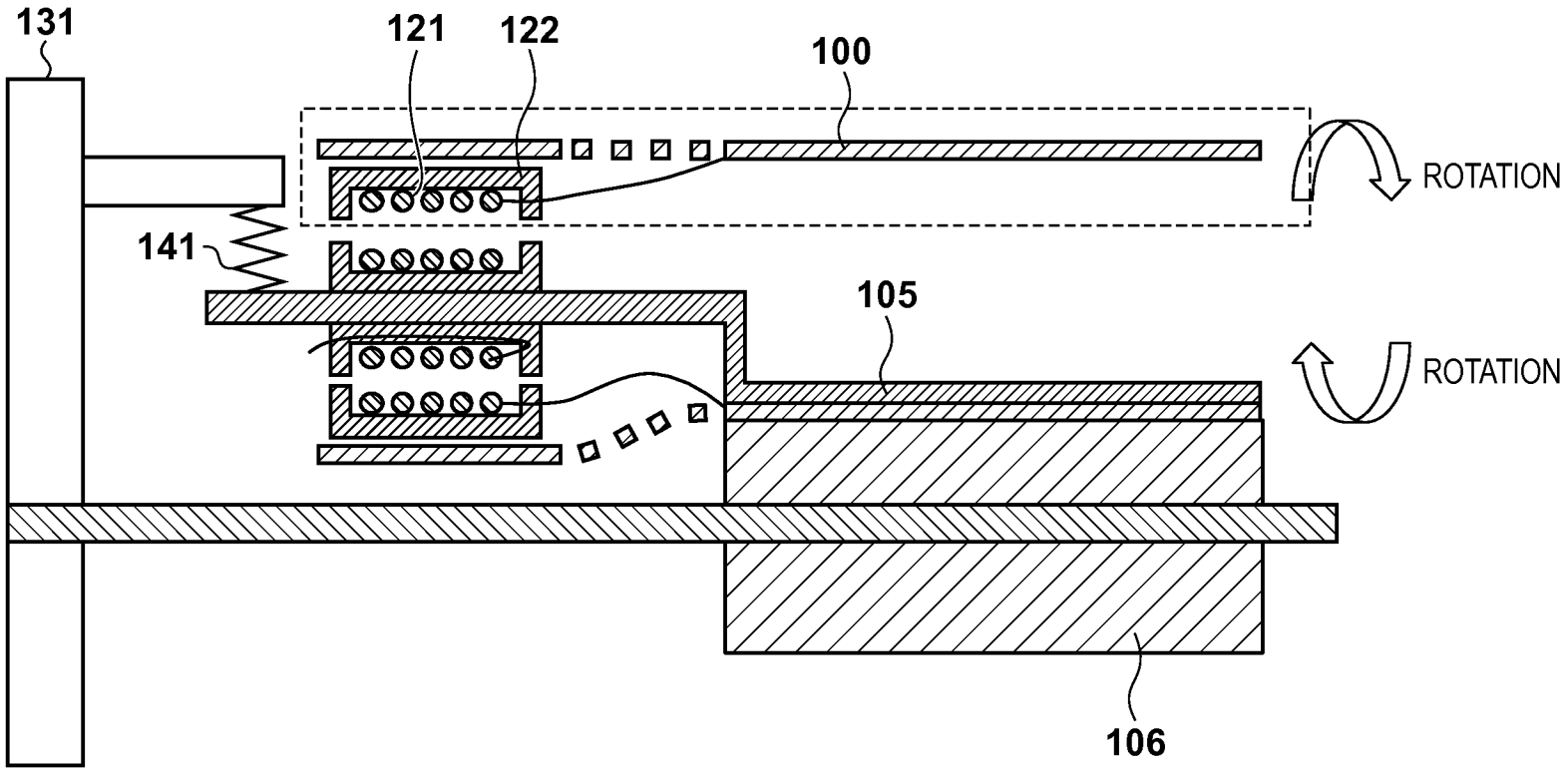
FIG. 5 is a view showing an arrangement for forming a nip portion.

FIG. 5 is a view showing the arrangement of a fixing portion for the pressing/holding member 105, the pressing roller 106, a housing 131, and the like in order to form a nip portion. A spring member 141 is interposed between the pressing/holding member 105 and the housing 131 so that the pressing/holding member 105 adds a pressure to the pressing roller 106. The pressing roller 106 is axially supported and positioned by the housing 131. The pressing/holding member 105 and spring member 141 add a pushing pressure to the pressing roller 106, forming a nip portion. Although the spring member 141 is arranged on only the left side in FIG. 5, a pressing mechanism formed from the housing 131 and spring member 141 may be arranged on the opposite side.

Figure 6:
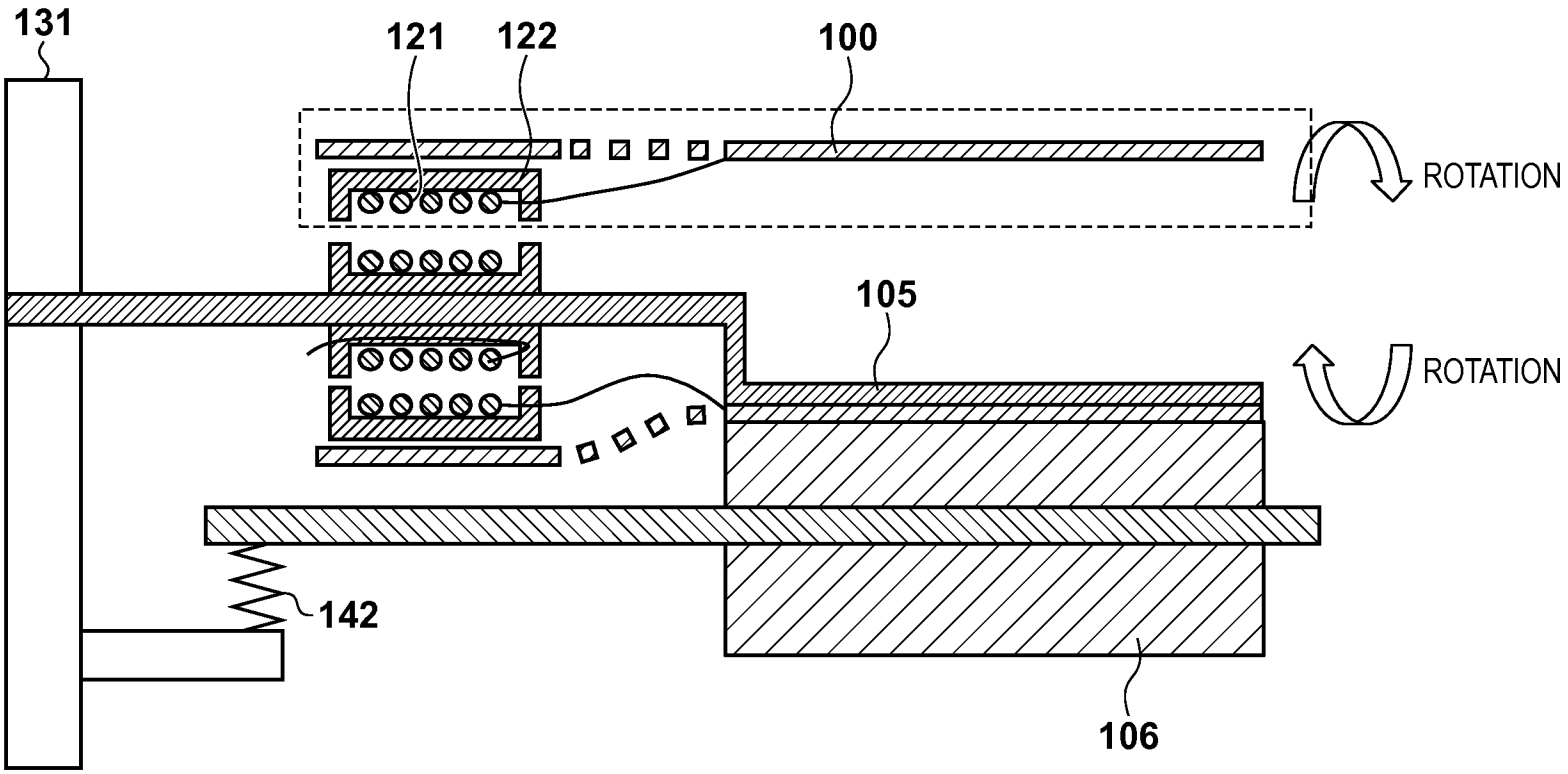
FIG. 6 is a view showing an arrangement for forming a nip portion.

FIG. 6 shows an example in which a spring member 142 is interposed between the pressing roller 106 and the housing 131 in order to form a nip portion. The pressing/holding member 105 is fixed to the housing 131. By arranging the spring member 142 on the pressing roller 106 in this manner, a nip portion may be formed between the fixing film 100 and the pressing roller 106. Although the spring member 142 is arranged on only the left side in FIG. 6, a pressing mechanism formed from the housing 131 and spring member 142 may be arranged on the opposite side.

As described above, the fixing device 10 is formed to supply electric power to the heating layer 101*a* via a plurality of layers arranged in the fixing film 100. This arrangement is advantageous because a cable used to supply electric power, and the like are not tangled around the pressing/holding member 105 when the fixing film 100 rotates. That is, power supply becomes easy because electric power is supplied from one end portion of the fixing film 100 to the heating layer 101*a* serving as a heating element via at least two different layers.

In particular, the fixing film 100 is formed from the heating layer 101*a*, second insulating layer 102*b*, and the first electrical conducting layer 103*a*. Further, the third electrical conducting layer 103*c* for electrically connecting the heating layer 101*a* and the first electrical conducting layer 103*a* is arranged at the other end portion of the fixing film 100. A current having passed through the heating layer 101*a* is returned by the third electrical conducting layer 103*c*, and flows through the first electrical conducting layer 103*a* (a current sometimes flows through an reverse path). Therefore, even if a power source is arranged on one end side of the fixing film 100, a cable is unnecessary. That is, a cable which may be tangled around the pressing/holding member 105 can be omitted.

Uniforming the thickness of the fixing film 100 results in uniform pressure addition and heating. That is, an image on the sheet P can be stably fixed. In general, the fixing film 100 has a cylindrical shape. Thus, the section of the fixing film 100 has a shape as shown in FIG. 4. However, a nip portion is formed between the fixing film 100 and the pressing roller 106 in order to fix an image on the sheet P at a portion where the heating layer 101*a* exists in the axial direction of the fixing film 100. As shown in FIG. 3, the shape of a section of the fixing film 100 at a portion where the nip portion is formed is different from that of a section at a portion where the coil and core exist. The shape of the fixing film 100 is not cylindrical in an actual operation and is partially deformed. The dotted portion of the fixing film 100 shown in FIGS. 2, 5, and 6 represents a shape transition portion for absorbing the difference of the sectional shape shown in FIGS. 3 and 4.

Figure 7:
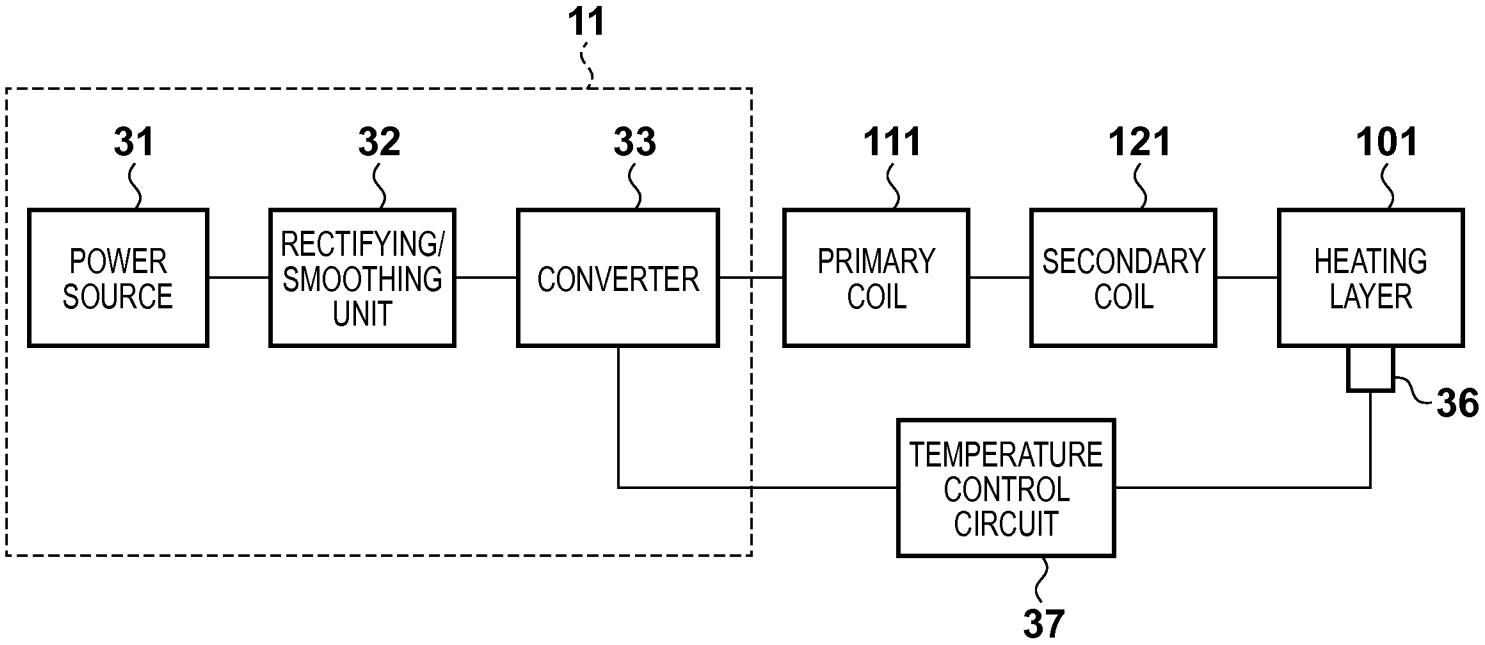
FIG. 7 is a block diagram showing the units of an electrical system.

FIG. 7 is a block diagram showing an electrical system according to the present invention. A rectifying/smoothing unit 32 rectifies and smooths electric power supplied from a power source 31 formed from a commercial AC power source. The electric power rectified and smoothed by the rectifying/smoothing unit 32 is output to a converter 33. The converter 33 converts the input electric power into a predetermined output voltage by a switching scheme, and outputs the voltage. As a large-power converter, for example, a full bridge scheme is used. The switching frequency is, for example, about several hundred kHz.

When the primary coil 111 is driven by a pulse voltage based on the output from the converter 33, a current is generated in the secondary coil 121 by electromagnetic coupling between the primary coil 111 and the secondary coil 121. The current is supplied to the heating layer 101*a* serving as a heating element. A temperature sensor 36 measures the temperature of the heating layer 101*a*. A temperature control circuit 37 controls the converter 33 so that the measured temperature reaches a predetermined target temperature.

According to the embodiment, the fixing film 100 is formed by stacking the heating layer 101*a*, the electrical conducting layer 103*a*, and the insulating layer 102*b* interposed between the heating layer 101*a* and the electrical conducting layer 103*a*. The two electrodes of the secondary coil 121 are connected to the heating layer 101*a* and electrical conducting layer 103*a* at one end portion of the fixing film 100 in the rotation axis direction, respectively. At the other end portion of the fixing film 100 in the rotation axis direction, the heating layer 101*a* and electrical conducting layer 103*a* are connected by the third electrical conducting layer 103*c* serving as an electrical conducting member arranged in the fixing film 100. A current supplied from the secondary coil 121 flows through the loop including the secondary coil 121, heating layer 101*a*, third electrical conducting layer 103*c*, and first electrical conducting layer 103*a*. Since the third electrical conducting layer 103*c* and first electrical conducting layer 103*a* function as a current return path or supply path, electric power can be supplied easier, compared to conventional wiring of a power supply wire. Since there is no power supply wire, no power supply wire is tangled around the pressing/holding member 105. Further, no conventional zigzag pattern is necessary, so the problem of image unevenness arising from the zigzag pattern can be solved. When the fixing film 100 is formed from a flexible body, the problem of image unevenness can be further efficiently solved.

In the embodiment, the first electrical conducting layer 103*a* is a cylindrically-shaped conductor with a uniform thickness. Therefore, the problem of image unevenness arising from the return path can be solved, unlike a related art in which a linear return path is formed.

According to the embodiment, the secondary coil 121 is fixed to one end portion of the fixing film 100 and rotates together with the fixing film 100. The primary coil 111 is arranged to face the secondary coil 121. By electromagnetic coupling between the primary coil 111 and the secondary coil 121, electric power is transmitted from the primary coil 111 to the secondary coil 121 in a non-contact manner. Note that one end of the secondary coil 121 is connected to the heating layer 101*a* via the second electrical conducting layer 103*b*, and the other end of the secondary coil 121 is connected to the first electrical conducting layer 103*a*. According to the embodiment, since electric power can be supplied to the heating layer 101*a* in a non-contact manner, the fixing device 10 excellent in durability and reliability can be provided in comparison with a related art using a contact scheme such as an electrical brush.

According to the embodiment, the primary coil 111 is wound around the primary core 112. One end of the pressing/holding member 105 is inserted into a through hole formed in the primary core 112. Hence, a magnetic path can be formed efficiently while the pressing/holding member 105 can be easily fixed to the housing 131.

Note that the third electrical conducting layer 103*c* may be formed from an electrical conducting heating member. In a fixing device which requires a large amount of heat at the end portion of the fixing film 100, it is effective to form the electrical conducting layer 103*c* from an electrical conducting heating member.

It is also possible to arrange the second electrical conducting layer 103*b* serving as a circularly-shaped low-resistance member (ring-shaped electrical conducting member) at one end portion of the heating layer 101*a* and connect the secondary coil 121 to the second electrical conducting layer 103*b*. This implements uniform electric power supply in the circumferential direction of the fixing film 100. This is effective in preventing temperature unevenness of the fixing film 100.

In the embodiment, electric power is supplied in a non-contact manner. However, the effect of the present invention is to implement fixing stability for a fixing film including a heating element. Therefore, as another power supply method, a contact transmission scheme may be employed instead of the non-contact transmission scheme. In other words, the same effect as that of the embodiment can be obtained even when electric power is supplied in contact with the electrical conducting layers 103*a*, 103*b*, 103*c* and 103*d* at one end of the fixing film 100 in the axial direction by using a brush, slip ring, or the like.

The second embodiment of the present invention will be described. The second embodiment is different from the first embodiment in that a first electrical conducting layer 103*a*, which forms a return path together with a third electrical conducting layer 103*c*, is replaced with a heating layer. According to the second embodiment, since there are two heating layers, the effect capable of relatively shortening the heating time per area on the circumferential surface of a fixing film 100 can be expected.

Figure 8:
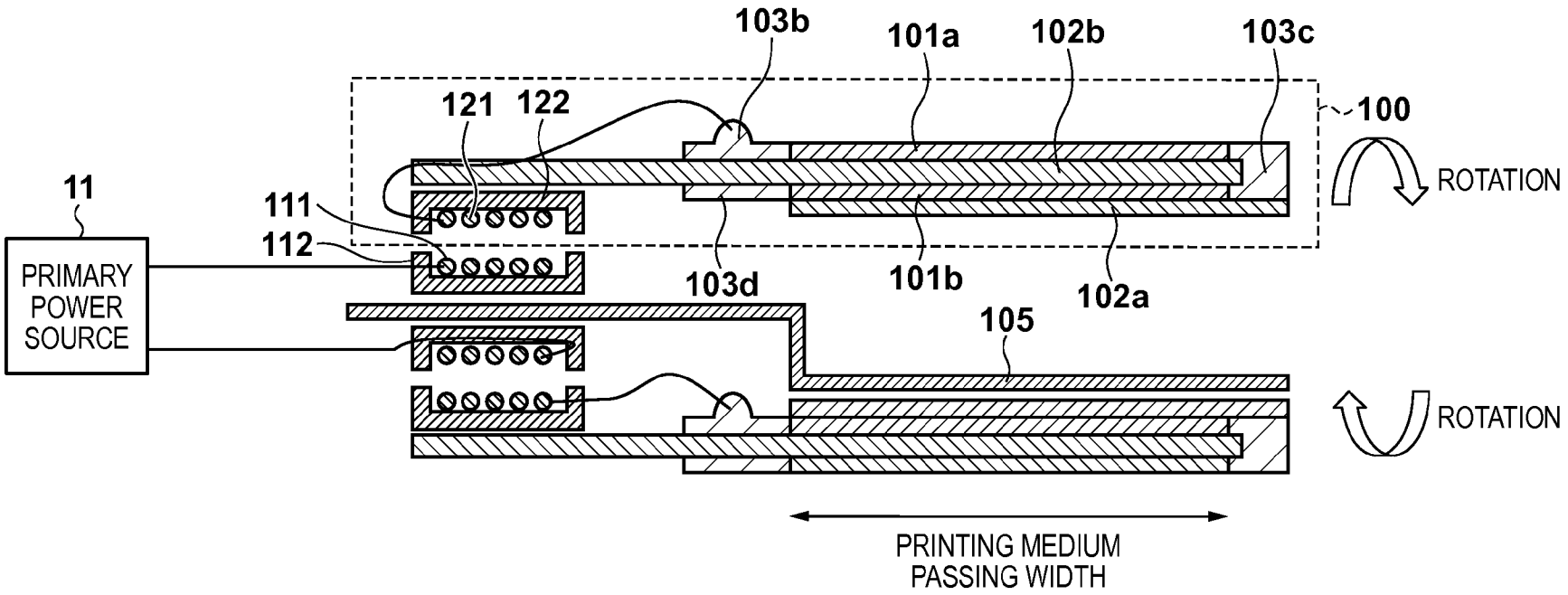
FIG. 8 is a view showing the arrangement of a fixing device.

A fixing device according to the second embodiment will be explained with reference to FIG. 8. The same reference numerals as those in the first embodiment denote the same parts, and a description thereof will be simplified. In the second embodiment, out of a plurality of layers forming the fixing film 100, the first electrical conducting layer 103*a* arranged to return and supply a current to a secondary coil 121 is replaced with a second heating layer 101*b*, as shown in FIG. 8. That is, a first heating layer 101*a* and the second heating layer 101*b* are arranged as two heating layers.

As shown in FIG. 8, a current generated in the secondary coil 121 by electromagnetic induction is temporarily supplied to the first heating layer 101*a* positioned on the outer circumferential side of the fixing film 100 via a second electrical conducting layer 103*b*. Then, the current also flows through the second heating layer 101*b* positioned on the inner circumferential side of the fixing film 100 via the third electrical conducting layer 103*c* serving as a return portion. Further, the current returns to the secondary coil 121 via a fourth electrical conducting layer 103*d*. Note that the direction of a current may be opposite. Each layer basically has a cylindrical shape. The secondary coil 121, the second electrical conducting layer 103*b*, the first heating layer 101*a*, the third electrical conducting layer 103*c*, the second heating layer 101*b*, and the fourth electrical conducting layer 103*d* form a circuit. In an electrical circuit, the first heating layer 101*a* arranged on the outer circumferential side and the second heating layer 101*b* are series-connected. Note that the first heating layer 101*a* may be replaced with an electrical conducting layer.

In the second embodiment, the third electrical conducting layer 103*c* is arranged as a return portion, as shown in FIG. 8. However, it is also possible to replace the third electrical conducting layer 103*c* with a heating layer and form one heating layer from the above-mentioned three heating layers in an electrical circuit.

As described above, according to the second embodiment, the first electrical conducting layer 103*a* is formed from an electrical conducting heating member (second heating layer 101*b*) arranged separately from the heating layer 101*a*, and the two heating layers are stacked via an insulation layer. This can improve the heating efficiency of the fixing film 100, compared to the first embodiment. The temperature of the fixing film 100 can rise from room temperature to a target fixing temperature in a shorter time. The remaining effects are the same as those already described in the first embodiment.

Others

Figure 9:
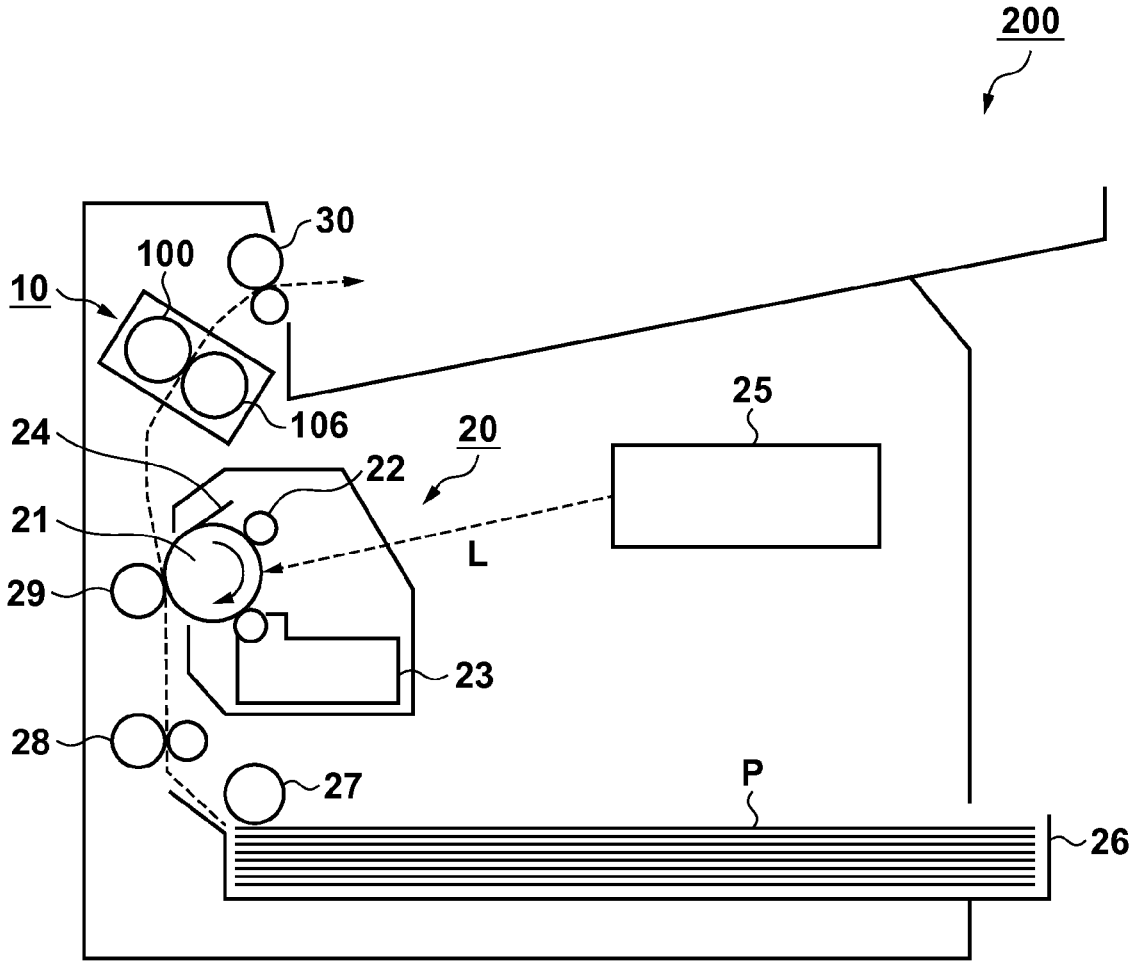
FIG. 9 is a view showing the arrangement of an image forming apparatus.

The basic arrangement of an image forming apparatus to which a fixing device 10 according to the present invention is applicable will be explained with reference to FIG. 9. As shown in FIG. 9, an image forming apparatus 200 according to the first embodiment is a monochrome image forming apparatus including an image forming unit 20 containing a photosensitive drum 21 serving as an image carrier and photosensitive body. The image forming unit 20 functions as an image forming unit which forms an unfixed image on a sheet P.

In the image forming unit 20, a charging roller 22 uniformly charges the surface of the photosensitive drum 21. A laser scanner 25 serving as an exposure unit deflects a laser beam L, which is ON-OFF modulated in accordance with image data, by a rotary polygon mirror, and scans the surface of the photosensitive drum 21 with the deflected laser beam L. As a result, an electrostatic latent image corresponding to the image data is formed on the surface of the photosensitive drum 21.

A developer 23 charges toner in it to have a polarity opposite to that of the electrostatic latent image, and applies the toner to develop the electrostatic latent image into a toner image. A cleaning blade 24 rubs the photosensitive drum 21, and removes transfer residual toner which remains on the surface of the photosensitive drum 21 after passing through a transfer unit.

Sheets P in a sheet cassette 26 are picked up one by one by a pickup roller 27 and fed to a conveyance path. A registration roller 28 and counter roller nip and convey the sheet P in synchronism with an image formation timing in the image forming unit 20. The toner image is transferred to the sheet P when the sheet P passes through the transfer unit formed from the photosensitive drum 21 and a transfer roller 29. A transfer voltage is applied from a power source (not shown) to the transfer roller 29. The sheet P carrying the unfixed toner image is passed to the fixing device 10. The fixing device 10 functions as a fixing unit which heats the sheet P carrying the unfixed toner image and adds a pressure to it to fix the unfixed image onto the sheet by the above-described arrangement. More specifically, the fixing device 10 heats, by the fixing film 100, the sheet P carrying the unfixed toner image. Further, the fixing film 100 and pressing roller 106 add a pressure to the sheet P carrying the unfixed toner image, thereby fixing the image onto the surface of the sheet P. A discharge roller 30 and counter roller nip and convey the sheet P, and discharge it onto a discharge tray.

According to the embodiment, the fixing device 10 does not require a conventional zigzag pattern, and can solve the problem of image unevenness arising from the zigzag pattern. The remaining effects are the same as those already described in the first and second embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-001289, filed Jan. 8, 2013 which is hereby incorporated by reference herein in its entirety.

What is claimed is:

1. A fixing device comprising:

a hollow fixing body configured to rotate and generate heat to heat an unfixed image carried by a sheet;

a pressing body configured to rotate in press contact with the fixing body and add a pressure to the sheet;

a pushing member configured to push the fixing body against the pressing body from an inner side of the fixing body and slide on the inner side of the fixing body; and a power supply unit configured to supply electric power for causing the fixing body to generate heat, wherein the fixing body is formed by stacked layers including a first heating layer, a second heating layer, and an insulation layer interposed between the first heating layer and the second heating layer, wherein two electrodes of the power supply unit are configured to connect to the first heating layer and the second heating layer at one end portion of the fixing body in a rotation axis direction, wherein the first heating layer and the second heating layer are connected by an electrical conducting member arranged in the fixing body at the other end portion of the fixing body in the rotation axis direction, and wherein a current supplied from the power supply unit flows through one of two electrodes, the first heating layer, the electrical conducting member, the second heating layer and the other of the two electrodes.

2. The device according to claim 1, wherein the electrical conducting member includes a cylindrically-shaped conductor with a uniform thickness.

3. The device according to claim 1, further comprising:

a secondary coil fixed to one end portion of the fixing body and configured to rotate together with the fixing body; and a primary coil arranged to face the secondary coil, wherein electric power is transmitted from the primary coil to the secondary coil in a non-contact manner by electromagnetic coupling between the primary coil and the secondary coil, and the secondary coil has one end connected to the first heating layer and the other end connected to the second heating layer.

4. The device according to claim 3, further comprising a primary core around which the primary coil is wound, wherein one end of the pushing member is inserted into a through portion formed in the primary core.

5. The device according to claim 1, wherein the electrical conducting member includes an electrical conducting heating member.

6. The device according to claim 1, wherein the fixing body includes a flexible body.

7. The device according to claim 1, further comprising a ring-shaped electrical conducting member which is electrically connected to one end portion of the first heating layer, wherein electric power is supplied from the power supply unit via the ring-shaped electrical conducting member.

8. An image forming apparatus comprising:

an image forming unit configured to form an unfixed image on a sheet; and a fixing unit configured to fix the unfixed image onto the sheet by heating the sheet carrying the unfixed image and adding a pressure to the sheet, wherein the fixing unit comprises:

a hollow fixing body configured to rotate and generate heat to heat the unfixed image carried by the sheet;

a pressing body configured to rotate in press contact with the fixing body and add pressure to the sheet;

a pushing member configured to push the fixing body against the pressing body from an inner side of the fixing body and slides on the inner side of the fixing body; and a power supply unit configured to supply electric power for causing the fixing body to generate heat, wherein the fixing body is formed by stacked layers including a first heating layer, a second heating layer, and an insulation layer interposed between the first heating layer and the second heating layer, wherein two electrodes of the power supply unit are connected to the first heating layer and the second heating layer at one end portion of the fixing body in a rotation axis direction, wherein the first heating layer and the second heating layer are connected by an electrical conducting member arranged in the fixing body at the other end portion of the fixing body in the rotation axis direction, and wherein a current supplied from the power supply unit flows through one of the two electrodes, the first heating layer, the electrical conducting member, the second heating layer, and the other of the two electrodes.

* * * * *